US009289041B2

(12) United States Patent
Brown

(10) Patent No.: US 9,289,041 B2
(45) Date of Patent: Mar. 22, 2016

(54) PORTABLE MODULAR COOKING ENABLED TRAVEL BAG

(71) Applicant: Francis M Brown, Marlborough, CT (US)

(72) Inventor: Francis M Brown, Marlborough, CT (US)

( * ) Notice: Subject to any disclaimer, the term of this patent is extended or adjusted under 35 U.S.C. 154(b) by 394 days.

(21) Appl. No.: 13/998,321

(22) Filed: Oct. 21, 2013

(65) Prior Publication Data

US 2014/0116413 A1 May 1, 2014

Related U.S. Application Data

(60) Provisional application No. 61/795,740, filed on Oct. 25, 2012.

(51) Int. Cl.

| | |
|---|---|
| ***F24C 15/30*** | (2006.01) |
| ***A45C 5/14*** | (2006.01) |
| ***A45F 3/46*** | (2006.01) |
| ***A45C 13/02*** | (2006.01) |
| ***A45C 15/00*** | (2006.01) |
| *F24B 1/08* | (2006.01) |
| *F25D 3/08* | (2006.01) |

(52) U.S. Cl.

CPC . *A45C 5/14* (2013.01); *A45C 13/02* (2013.01); *A45C 15/00* (2013.01); *A45F 3/46* (2013.01); *F24B 1/08* (2013.01); *F25D 3/08* (2013.01)

(58) Field of Classification Search

CPC ..... A45C 1/08; A45C 13/02; A45C 15/00; F24B 1/08; F25D 3/08; A45F 3/46

USPC ..... 126/276, 37 R; 219/202, 528; 62/326, 62/457.5

See application file for complete search history.

(56) References Cited

U.S. PATENT DOCUMENTS

| | | | | |
|---|---|---|---|---|
| 4,337,081 | A * | 6/1982 | Gay | A01N 43/82 504/170 |
| 4,609,084 | A * | 9/1986 | Thomas | A45C 9/00 190/110 |
| 5,257,509 | A * | 11/1993 | Harris | A45C 3/02 150/106 |
| 5,293,859 | A * | 3/1994 | Lisker | A47J 37/0768 126/25 A |
| 6,541,738 | B1 * | 4/2003 | Casasola | A45C 11/20 219/387 |
| 6,915,797 | B1 * | 7/2005 | Lightbourne | F24C 7/10 126/9 R |
| 7,415,794 | B1 * | 8/2008 | Thompson | A01K 97/22 206/315.11 |
| 2008/0296286 | A1 * | 12/2008 | Liang | A61F 7/02 219/528 |

* cited by examiner

*Primary Examiner* — Gregory Huson
*Assistant Examiner* — Nikhil Mashruwala

(57) ABSTRACT

The invention is a portable modular travel bag with modular components intended to provide the ability to store and cook food. The travel bag contains slots and a power supply that allows to user to plug in and out components including at least a toaster, an egg cooker, a meat warmer, a refrigerator, a microwave, a coffee maker, a juicer, and a blender.

16 Claims, 6 Drawing Sheets

PORTABLE MODULAR COOKING ENABLED TRAVEL BAG

CROSS REFERENCE TO RELATED APPLICATIONS

This application claims the benefit of U.S. Provisional Application No. 61/795,740, filed Oct. 25, 2012 the contents of which are incorporated entirely by reference herein.

BACKGROUND

Today's society and culture has become increasingly mobile and de-centralized. The competitive corporate world, internet, mobile devices and international economy have contributed to a workforce that is always on the move. This global mobile economy has created a workforce that is in constant flux both due to the speed at which the internet and mobile devices facilitate business transactions and the speed at which customers and clients demand response. Working at this rapid pace from different locations brings about a number of concerns and problems. Obtaining safe, good and nutritious food on the go has thus become a major challenge for people. Fast food may be convenient but generally has low nutritional value.

Food available on mass transportation like on trains and planes is also generally low quality and may pose safety concerns with contamination, etc.

Accordingly, it would be desirable to have a way to provide people with safe, good and nutritious food in a mobile, convenient manner.

BRIEF DESCRIPTION OF THE DRAWINGS

A more detailed understanding may be had from the following description, given by way of example in conjunction with the accompanying drawings wherein.

DETAILED DESCRIPTION

In some embodiments, the invention relates to a portable travel bag with modular components intended to provide the ability to store and cook food with outside a kitchen. The device is designed to comply with most airline luggage requirements, using lightweight components and materials. The device contains slots and a power supply that allows the user to plug in and out components including a toaster, an egg cooker, a meat warmer, a refrigerator, a microwave, a coffee maker, a juicer, and a blender. The bag includes space to pack other travel necessities to create an all-in-one travel capability for those that prefer the flexibility to cook their own light fare, to store perishable items, and to make hot or cold drinks.

Figure 1:
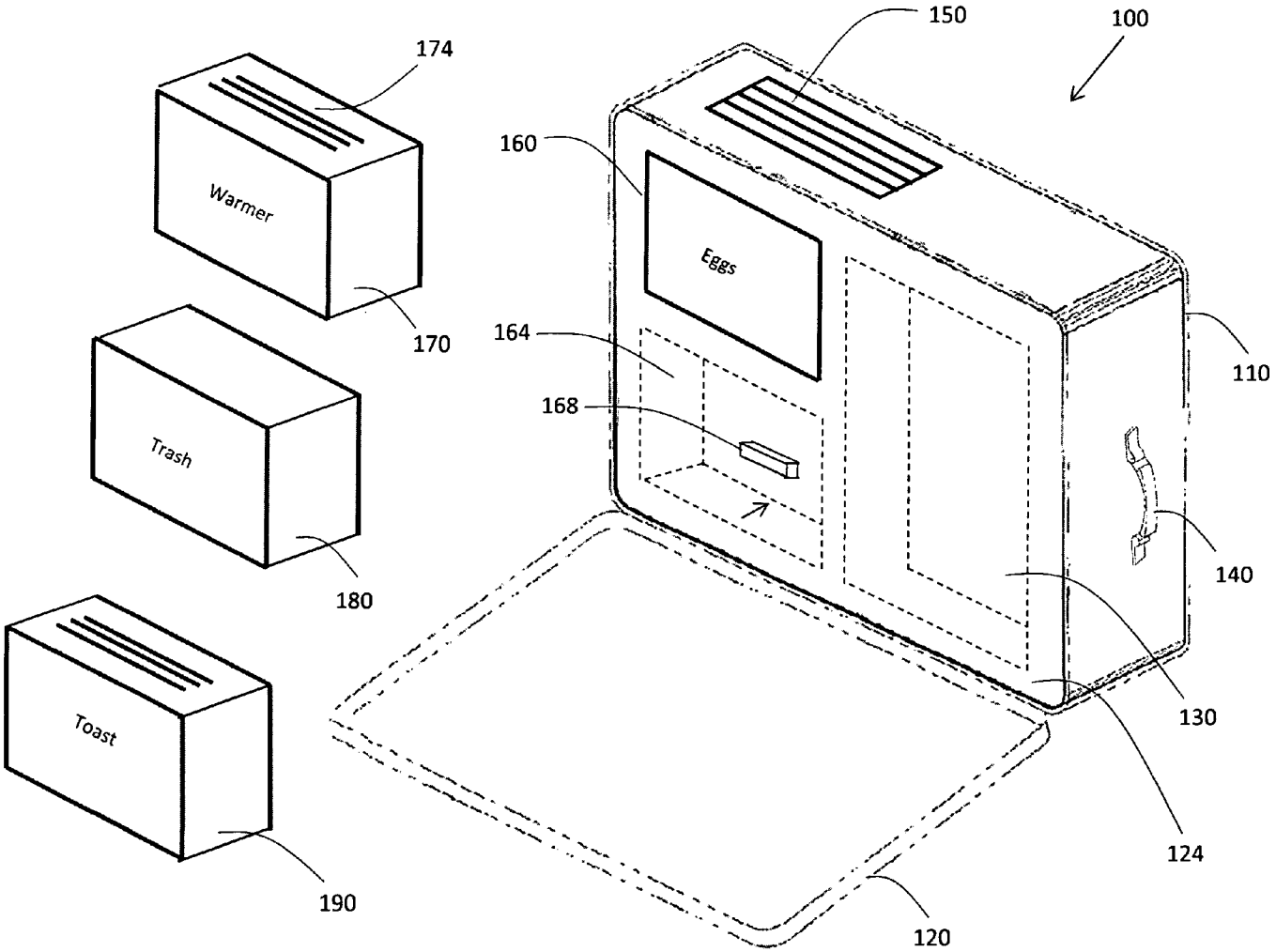
FIG. 1 shows an exemplary cooking apparatus of the present invention.

Referring now to the drawings wherein like numerals refer to like parts, FIG. 1 generally illustrates a cooking enabled modular bag or suitcase system 100. More specifically, the present invention relates to a multi-compartmented or modular bag or suitcase system 100 for use for cooking certain items while travelling. System 100 includes a suitcase or bag 100 that includes a body or enclosure portion 100 and a lid or cover portion 120. Enclosure 100 includes a surrounding insulative portion 124 that defines a plurality of interior compartments 130. In particular, compartment 130 is suitable for holding travel items such as clothing, books, toiletries, accessories or other items separately within enclosure 110. Enclosure 110 also include a handle 140 and one or more vents 150 formed or implemented on one or more surfaces of enclosure 110. Enclosure 110 also includes one or more other compartments 160 and 164 that are sized and configured to receive one or more modules or components 170, 180 and 190 for cooking. For example, enclosure 164 may also be configured with a docking port or interface 168 to mate or receive components 170, 180 and 190. In one embodiment, the electrical/power circuitry is embedded in the bag 100, and will connect the battery or external source of power to the modules via built-in receptacles. In one embodiment, the receptacle will only be powered when a module of locked into place via the spring-loaded locking tabs.

Enclosure 100 may be configured in hard sided and soft sided versions, optimized in both dimensions and weight to adhere to current travel standards. The hard sided cases may be made of durable Polycarbonate ABS hard shell materials for maximum impact resistance and the soft sided cases will be made of strong but lightweight 1680d nylon. Some exemplary sizes of the enclosure may be: a full sized checkable bag measuring for example in the range of 29"H×22"W×11"D (expandable to 13"D) and a carry on version measuring for example in the range of 21" H×15" W×8.5". D. The empty weight of the full sized bag without modules but including the battery and power supply will be approximately 28 lbs. The empty weight for the carry-on bag without the modules but including the battery and power supply will be approximately 18 lbs.

Figure 2:
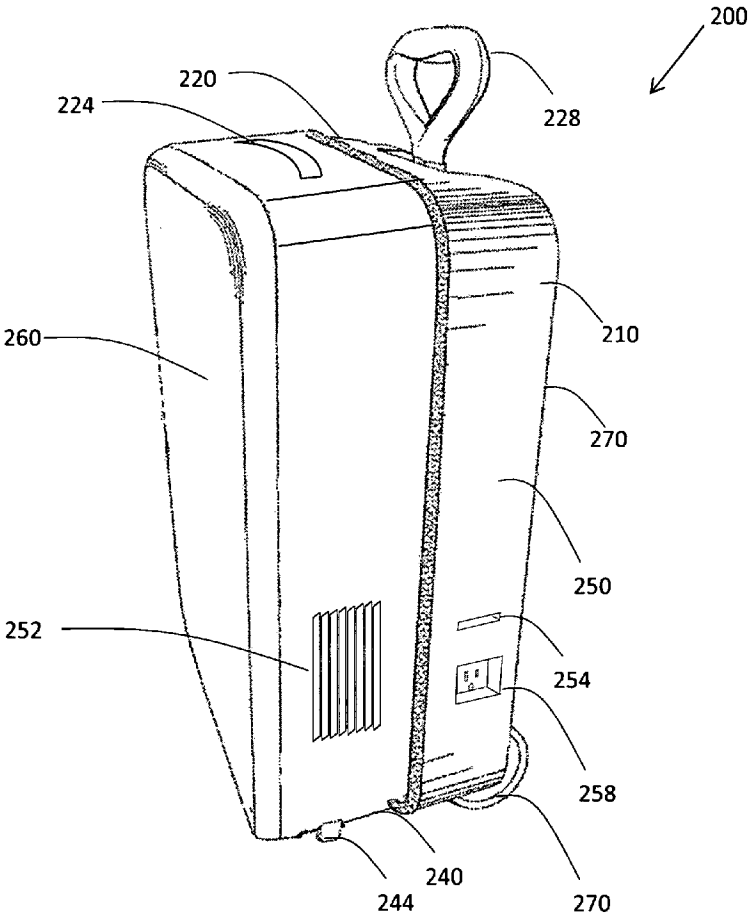
FIG. 2 shows a side view of the cooking apparatus of the present invention.

Referring now to FIG. 2, another embodiment of a suitcase system 200 of the present invention is shown. Suitcase system 200 includes a modular bag or case 210 that is constructed in a generally rectangular shape and may have a soft side or hard side construction or a combination of both in a semi-rigid construction. Modular bag 210 has a top or upper/proximate surface 220, a lower or bottom/distal surface 240 having wheels 244, sidewalls 250, a front surface defining a lid or cover 260 and a back surface 270. Preferably, at least a portion of the sidewalls 250 and the bottom surface 240 are reinforced to provide durable surfaces for travel.

Modular bag or case 210 also includes a fixed handle 224 and an extendible or extensible telescopic type handle 228. Handle 228 may be connected to the back surface 270 of the modular bag 210 allowing for wheeled transport but it should be understood that other types of handle and wheels may be implemented by those skilled in the art. Additionally, modular bag 210 of the present invention may, of course, be implemented without the extendible handle 228 and/or the wheels 244 and just with a fixed handle 224.

Sidewalls 250 may also include one or more vents 252 and interfaces 254 and 258. Interfaces 254 and 258 may include computer or charging type interfaces such as USB or AC/DC type interfaces used for charging to power the cooking components of system 200. In some embodiments, the modular bag 210 will feature a battery and power supply with handling capacity of up to 1350 VA and 810 W, while the carry-on size will feature a smaller capacity battery, capable of handling 750 VA and 450 W of load. The power units will measure for example in the range of 11"H×22"W×1.5"D in the large bag and for example in the range of 11"H×15"W×"1.5" D in the carry-on. The power units will contain battery packs comprised of, for example, Lithium Ion Batteries with no more than 25 grams of Equivalent Lithium Content (ELC) per battery. Other rechargeable battery types may be used including those with the following chemistries; Nickel Cadmium (NiCd), Nickel Metal Hydride (NiMH), Lithium Ion (Li Ion) and Sealed Lead Acid (SLA) variations (AGM, Gel).

Additionally, modular bag 210 may incorporate wheel 270 where each wheel 270 provide additional charging capability to the battery pack so that the battery can be charged as the travels wheels the cases during their travel. A variety of regenerative power mechanisms/recapturing/storing mechanisms, to capture and store energy in the system 200 may be used to capture and store the energy including using a spring, a flywheel, a battery or a capacitor, such as a linear electrical generator that charges a batterylike ultracapacitor when the system 200 moves or is shaken. In some embodiments, modular bag 210 may incorporate a permanent magnet that provides a constant magnetic field and a handle or interlocking twisting apparatus or other item that serves as the rotational winding to create the necessary electric field to generate the power required to power the components or charge the battery. The power that is generated from the wheels turning or a user's manual cranking, shaking or twisting will create power to recharge the batteries without finding an outside electrical source such as a wall outlet. The manually created energy is stored inside of internal rechargeable battery cells within each cooking component or within the bag 210 as a main or auxiliary power source and may be supplemented by conventional batteries or charging.

Moreover, cylindrical kinetic energy chargers may be embedded in each of the four corners of the case that further provide charging capability to the battery packs. As the case moves, whether while being wheeled by the user, stored in the trunk of a moving car, or in the luggage compartment of an airplane, the battery pack will be continuously charged, allowing longer usage of the modules without needing external source of A/C current for power.

Figure 3:
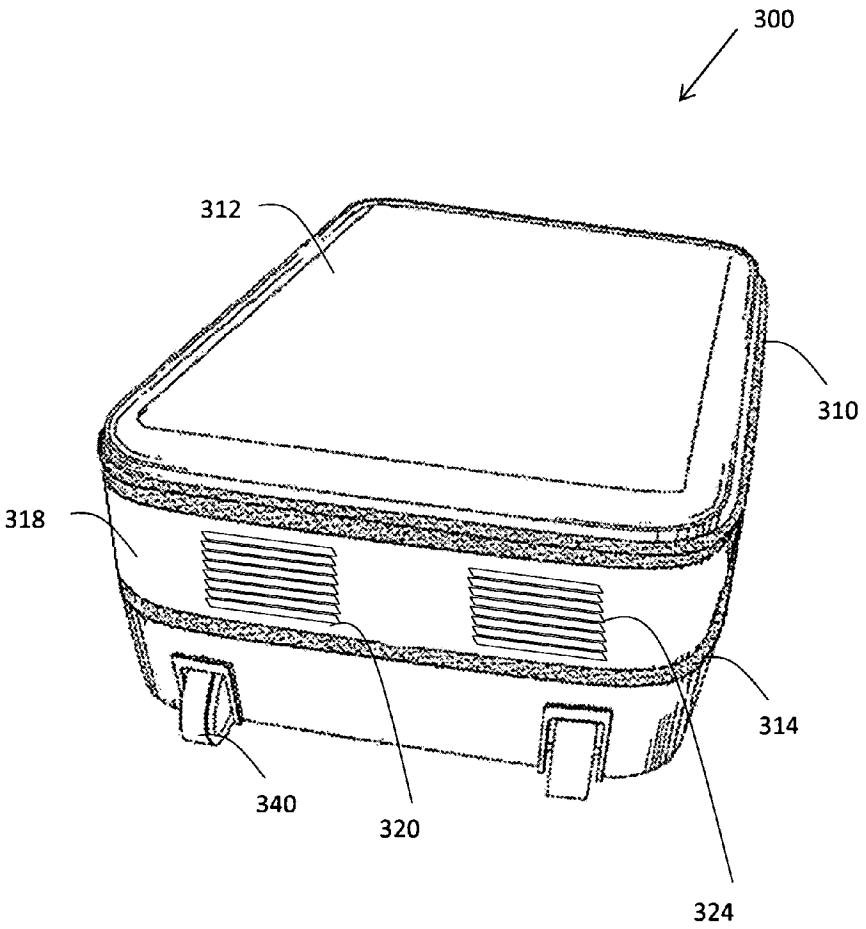
FIG. 3 shows a back view of the cooking apparatus of the present invention.

Referring now to FIG. 3, there is shown a a rear view of a modular bag system 300. Modular bag system 300 includes an enclosure 310 having a top or superior surface 312 and a bottom or inferior surface 314 connected by surrounding side or lateral surfaces 318. Lateral surfaces 318 may have vents 320 and 324 formed or integrated thereon as well as wheel 340. Vents 320 and 324 are positioned so that when interior cooking components are installed, the vents 320 and 324 provide for heat and odor dissipation. Vents 320 and 324 may include a plurality of louvers or slats to provide for adequate heat and odor dissipation and may be aided by an internal fan within enclosure 310. Odors from cooking may also be reduced via carbon filters in the vents.

Figure 4:
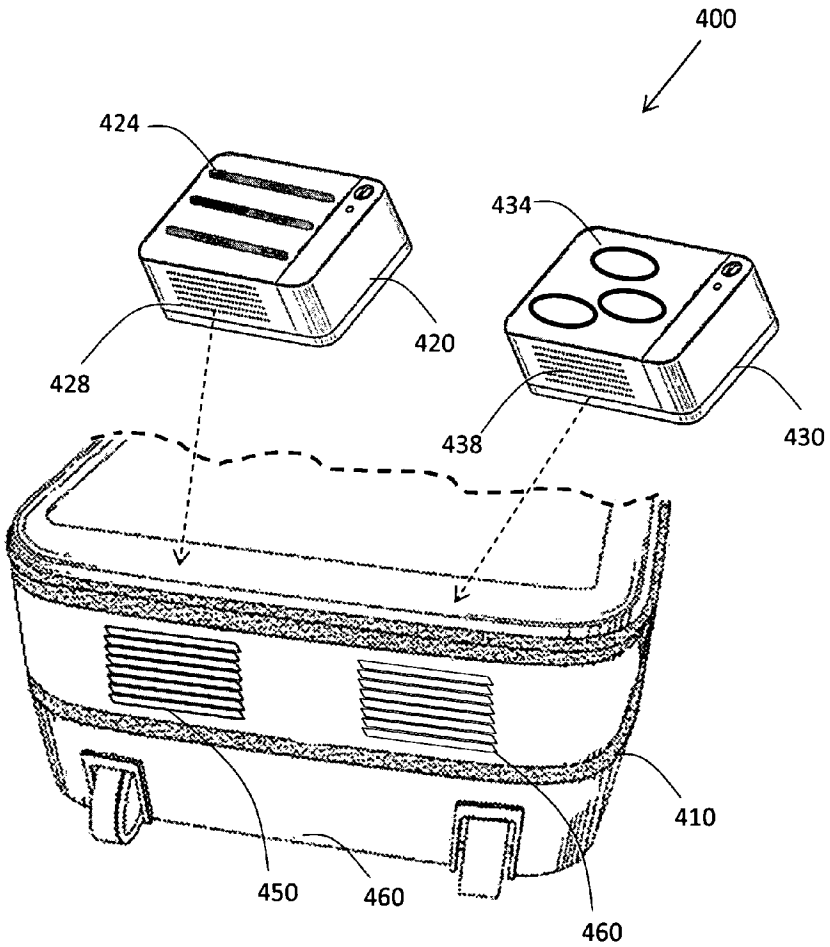
FIG. 4 shows an exploded back view of the cooking apparatus of the present invention.

Referring now to FIG. 4, an exploded view of a modular bag system 400 is shown. System 400 includes a main bag portion 410 adapted for receiving modular cooking implements or components 420 and 430. Cooking component 420 includes subcomponents 424 for cooking certain items like toast and cooking component 430 includes certain subcomponents 434 for cooking items like eggs, for example. Cooking components 420 and 430 may also include vents 428 and 438 respectively that are positioned so that when installed within main bag portion 410, the vents align with exterior vents 450 and 460 respectively. Positioning the cooking components 420 and 430 at a distal or lower end 460 of bag 410 provides for optimal weight distribution and stability of the bag when being wheels or carried.

Figure 5:
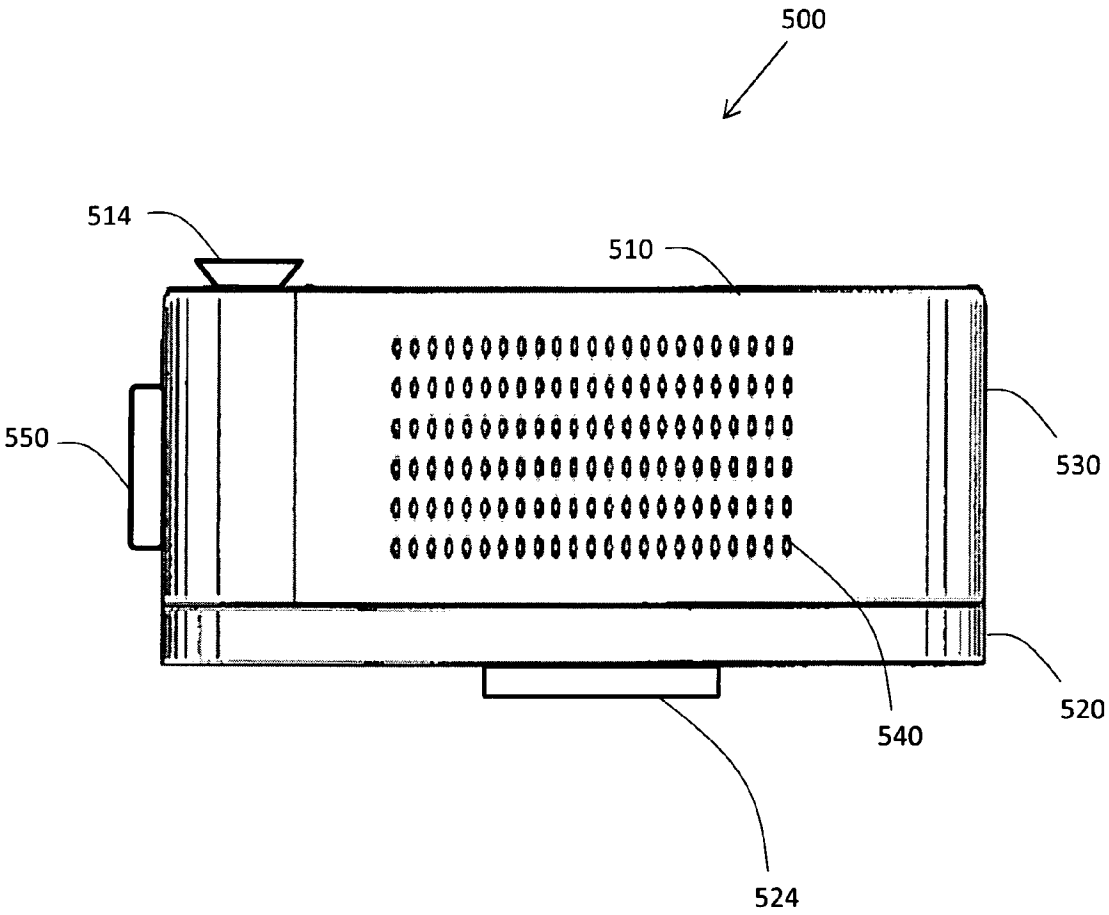
FIG. 5 shows a side view of a modular component of the cooking apparatus of the present invention.
Figure 6:
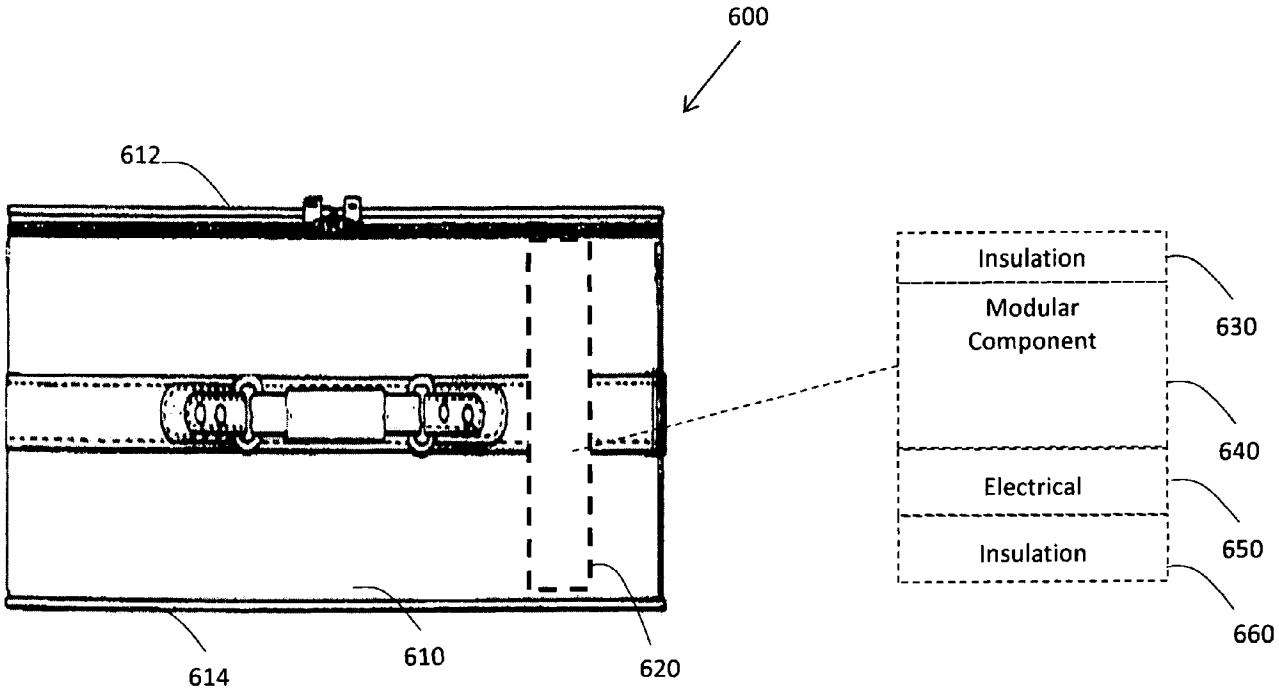
FIG. 6 shows a cut out view of the apparatus profile.

Referring now to FIG. 5, a side view of a modular cooking component or module 500 of the present invention is shown. Cooking component or module 500 may include top surface 510 that includes one or more cooking controls 514. Cooking component 500 may include a bottom surface 520 that includes a mating prong or interface extension 524 adapted for mating or interface within a modular bag compartment such as shown with respect to FIG. 1 where cooking component 500 may mate within opening 164 with interface 168. Cooking component 500 may also include sidewalls 530 extending between top surface 510 and 520. Sidewalls 530 may have one or more vents 540 for helping to dissipate heat and odor created by the cooking and may be simply a venting system with mechanical fins or may be assisted by an internal or external electrical fan. Bottom surface 520 may also include a slide-out drawer that is removable for easy disposal of crumbs or other debris. Cooking component may be self powered with an internal battery or be powered by interfacing with a power mechanism with the modular bag of the present invention.

In other embodiments, cooking component 500 may include a coupling tab 55 to help interface with another component. Interfacing may assist in transferring or sharing heat from one or more of the cooking components to be reclaimed for one or more of the other cooking components. Coupling tab may be a mechanical connection or electromechanical connect for enabling the transfer of heat from one component to another such as in a heat sink like arrange.

Each cooking module may measure for example in the range of 10"H×10" W×7"D, or may measure for example in the range of 21"H×10"W×10"D. The toaster/egg cooker/meat warmer, coffee/tea maker, and blender modules may each weigh approximately 4 lbs. The refrigerator and juicer may each weigh approximately 6.5 lbs., and the microwave will weigh approximately 11 lbs.

Referring to FIG. 5, a cut out view of a portable cooking bag 600 of the present invention is shown. Portable cooking bag 600 includes a body portion 610 having a top surface 612 and a bottom surface 614 that enclose an interior section 620. Interior section 620 may include one or more physical/electrical layers such as an insulation layer 630 that may be incorporated into top surface 612, a modular component layer 640, an electrical layer 650 that may include power and other electronics and another insulation layer 660. Insulation layers 630 and 660 may assist with protecting the modular component layer 640 and electrical layer 650 from a charge, heat, cold, impact and other perspectives. Insulation layers 630 and 660 may be constructed of any type of insulating material such as fiberglass, wool, synthetics, cellulose, polyurethane, polystyrene, etc. and may cushion the internal items in the bag from impact during travel as well as provide for heat and cold type insulation for the internal components and food within interior section 620. In the present invention, the bag and its components may be made of strong but lightweight materials such as plastics, carbon fiber, and titanium.

The modular approach of the present invention allows the user to customize the preparation and cooking needs for a given trip or for individual preferences. The product can be produced in differing sizes and have different numbers of slots based upon the size of the case. The bags contain lightweight flexible cloth heat shielding material to reflect radiant heat away from the interior of the bag. The case also acts as a standard suitcase, with room for clothes, toiletries, and other typical uses for suitcases. These features offer flexibility for a user based upon the type and duration of a trip. For instance, a carry-on sized case with a single slot can provide the user with the ability to pack overnight clothes and toiletries while also have a toaster to provide a small breakfast in his room. Modules are secured in place via spring-loaded locking tabs in the sides of the slotted enclosures. The modules can be released from the bag by depressing the tabs and lifting the component out of the slotted enclosures, each measuring 0.5" wide per side.

Power is provided by a set of built-in batteries within the case and a power supply that can be plugged into a standard outlet for directly powering the modules or for charging the batteries. A battery pack is embedded in each case that provides sufficient power to make at least two meals, depending upon the size and quantity of food being prepared.

The toaster module, containing heating elements made from nickel-chromium alloy, can produce heat up to approximately 310°. The excess heat from the toaster module is reclaimed to assist in warming the meat and cooking the egg in order to maximize energy efficiency. Additionally, the heat generated from cooking the egg may also be used to assist in warming the meal in order to recapture some of the energy generated in the system so that the heat/energy generated by the system may be reused efficiently. In this instances, cooking components have interfaces to other cooking components in order to help transfer or share energy such as heat between the components. Such a coupling or link may be mechanical or electrical between the components to efficiently transfer energy between the two.

In other embodiments, a piezoelectric cooler allows for the short-term storage of perishable items without the need for compressors or liquid coolants. The cooler will be capable of storing foods to 45° below the external temperature. For safety, replaceable fuses are embedded in the case in the event of overheating or electrical faults. Moreover, there are pressure sensitive tabs enclosed in the case that will interrupt the circuit when depressed to avoid accidental use of the modules while the case is closed. Storage compartments are also provided for utensils, plates, tableware and other cooking accessories. The cooking modules do not use open flames, and do not require fuel thus providing additional safety for the user. Lack of fuel or other combustible materials make these bags safe and effective for air travel, either as checked luggage or carry on and stowed in an overhead bin. The batteries are preferably not removable and fall within current Federal Aviation Administration regulations for air travel. This product can be brought on planes and used in hotel rooms as well as automobiles and while camping.

Two or more case sizes provide flexibility for differing cooking needs. A larger case will contain two slots that can hold two single unit modules or one double unit module. The single unit modules include a toaster, egg cooker/meat warmer, a refrigerator, a coffee/tea maker, a juicer, and a blender. A microwave is provided as a double-unit module due to electrical and size requirements. The modules slide into slots with two rims built into the case and lock into place. They can be easily switched in and out as needed. There is an electrical receptacle at the base of each slot that the modules plug into for power. Each single unit sized module contains a plug at the bottom that fits into the receptacle, while the double-unit size modules contain two plugs that align to two receptacles across the two slots in the case. The smaller case contains a single slot for any single unit sized module. The larger case will function with one or two single sized modules attached, or with on double sized module. The toaster/egg cooker/meat warmer will have capacity to toast 2 slices of bread, cook one egg, and heat approximately 3 ounces of pre-cooked meat. The refrigerator may have a capacity range of 1-10 liters. The coffee/tea maker component has the ability to brew in the range of 1-20 ounces of coffee or tea. The blender component may have a 1-20 ounce capacity.

Although features and elements are described above in particular combinations, each feature or element can be used alone or in any combination with or without the other features and elements. For example, each feature or element as described above with reference to FIGS. 1-6 may be used alone without the other features and elements or in various combinations with or without other features and elements. Sub-elements of the methods and features described above with reference to FIGS. 1-6 may be performed in any arbitrary order (including concurrently), in any combination or sub-combination.

What is claimed is:

1. A non fuel based portable modular cooking enabled travel bag comprising:

a portable carrying enclosure having a handle, an exterior body portion defining an interior modular compartment, and wheels for providing an auxiliary power source, wherein the exterior body portion has vents disposed on the body portion; and a plurality of modular cooking components disposed within the portable carrying enclosure, wherein each component is interchangeable with one or more of the other cooking components, one or more of the components having vents disposed thereon for alignment with the exterior body portion vents.

2. The portable modular cooking enabled travel bag of claim 1 wherein the modular cooking component comprise two or more of a toaster/egg cooker/meat warmer, a refrigerator, a microwave, a coffee maker, a juicer, and a blender.

3. The portable modular cooking enabled travel bag of claim 1 wherein a number of modular cooking components is determined based upon a size of the carrying enclosure.

4. The portable modular cooking enabled travel bag of claim 1 wherein heat from one or more of the cooking components is reclaimed for one or more of the other cooking components.

5. The portable modular cooking enabled travel bag of claim 1 wherein the cooking components are coupled together to share heat.

6. The portable modular cooking enabled travel bag of claim 1 further comprising a modular piezoelectric cooler configurable within the interior modular compartment.

7. The portable modular cooking enabled bag of claim 6, wherein the travel bag is universal serial bus chargeable.

8. A portable modular travel bag comprising:

an enclosure have a proximal end having a handle portion, a distal end having a plurality of wheels, a superior surface, an interior surface and a plurality of side portions defining an exterior portion that encloses a modular interior compartment, wherein the enclosure has a plurality of vents formed thereon and one or more charging openings; and a plurality of modular and interchangeable cooking components, wherein at least one of the cooking components has vents formed thereon for aligning with the enclosure vents when the cooking component is disposed within the interior compartment, where at least a portion of the energy for the cooking components is supplied by at least one of the wheels or one of the cooking components.

9. The portable modular travel bag of claim 8 wherein the travel bag is universal serial bus chargeable.

10. The portable modular travel bag of claim 8 wherein the travel bag is wall outlet chargeable.

11. The portable modular travel bag of claim 8 wherein the cooking components are sized equally for alignment within the modular interior compartment.

12. The portable modular travel bag of claim 8 wherein the cooking components include a docking portion for mating with the modular interior compartment.

13. A portable modular travel bag sized for carryon luggage standards comprising:

a semi-rigid enclosure have a proximal end having a handle portion, a distal end having a plurality of polyurethane wheels, a superior surface, an interior surface and a plurality of side portions defining an exterior portion that encloses a modular interior compartment, wherein the enclosure has a plurality of vents formed thereon and one or more charging interfaced disposed thereon;

a plurality of modular cooking modules comprising a heating module having vents for coupling with the enclosure vents, a cooling module, and a storage module; and a charging facility for powering the cooking module, the charging facility disposed within the semi-rigid enclosure.

14. The portable modular travel bag of claim 13 wherein the charging facility is universal serial bus based.

15. The portable modular travel bag of claim 13 wherein the modular cooking modules are adapted for installation at the distal end of the enclosure.

16. The portable modular travel bag of claim 13 wherein the cooking components are sized equally for alignment within the modular interior compartment.

* * * * *